United States Patent [19]

Ansite

[11] Patent Number: 4,664,108

[45] Date of Patent: May 12, 1987

[54] OXYGEN SUPPLY SYSTEM AND DEVICE THEREFOR

[75] Inventor: William K. Ansite, Glendale, Calif.

[73] Assignee: Figgie International Inc., Willoughby, Ohio

[21] Appl. No.: 614,027

[22] Filed: May 25, 1984

[51] Int. Cl.[4] ..... A62B 7/08

[52] U.S. Cl. ..... 128/202.26; 128/207.11

[58] Field of Search ..... 128/202.26, 207.11, 128/206.27

[56] References Cited

U.S. PATENT DOCUMENTS 3,292,617 12/1966 McDonough .
3,482,568 12/1969 Bovard .
3,536,456 10/1970 Bovard .
3,573,001 3/1971 Bovard .
3,591,343 7/1971 McGoff et al. .
3,599,636 8/1971 Gutman et al. .
4,138,218 2/1979 McClure, III ..... 128/202.26
4,140,765 2/1979 Martin et al. .
4,209,491 6/1980 Rich, III .
4,294,244 10/1981 Pasternack .

*Primary Examiner*—Henry J. Recla
*Attorney, Agent, or Firm*—Christel, Bean & Linihan

[57] ABSTRACT

A stand alone oxygen supply system associated with a mask assembly of the type including a face mask (28) and an inflatable head harness (26). The mask assembly is normally stored in a stowage box (10) which also includes a reservoir (20), a relatively large chemical oxygen generator in the form of a chlorate candle (18) and a plurality of relatively small oxygen supply devices in the form of small chlorate candles (38). The small candles are caused to be sequentially fired to maintain an oxygen supply under pressure within the reservoir (18) during storage and/or tests.

12 Claims, 10 Drawing Figures

Fig. 3.
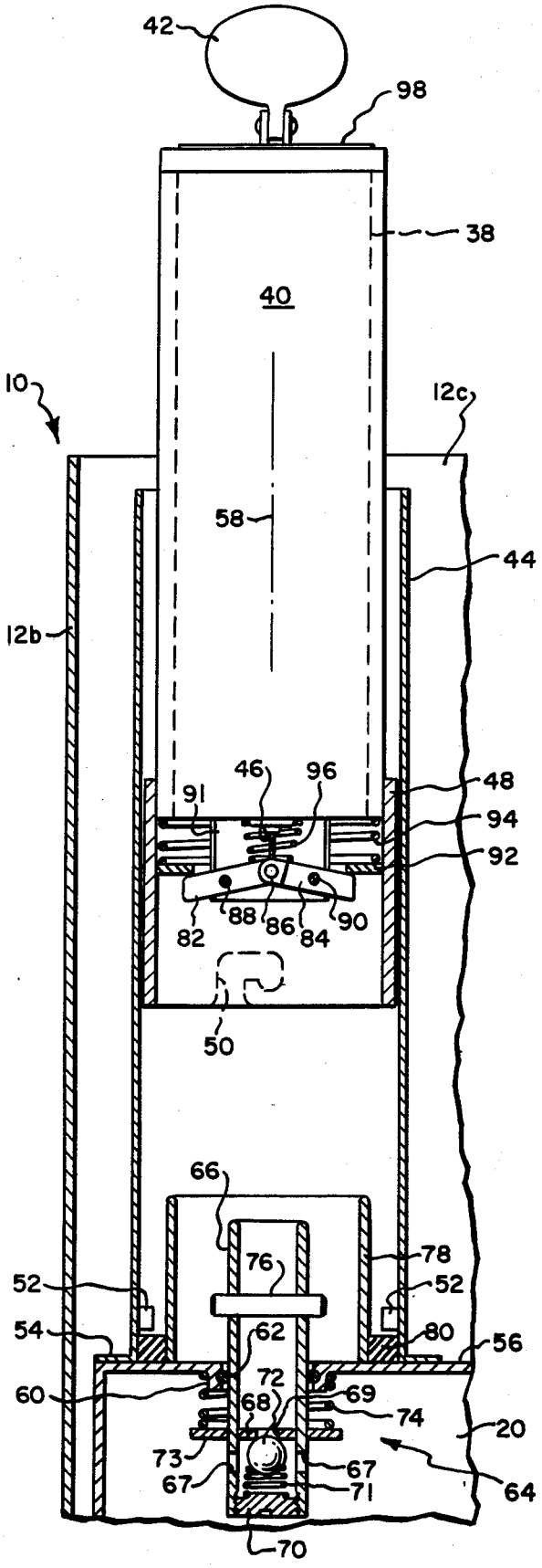
Fig. 4.
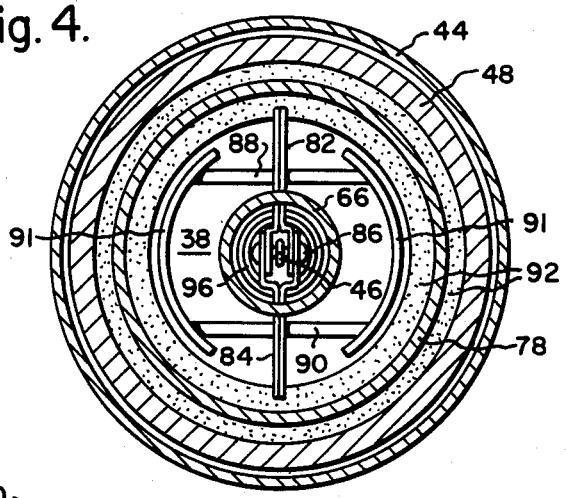
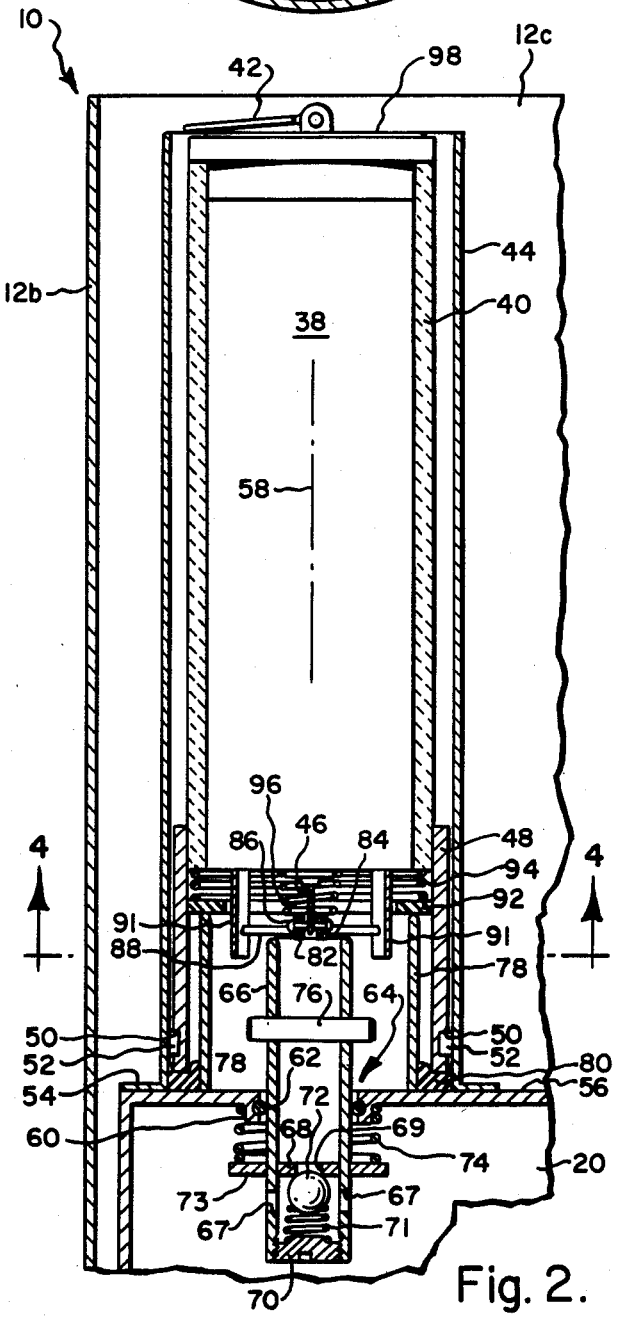
Fig. 2.

Fig. 5.
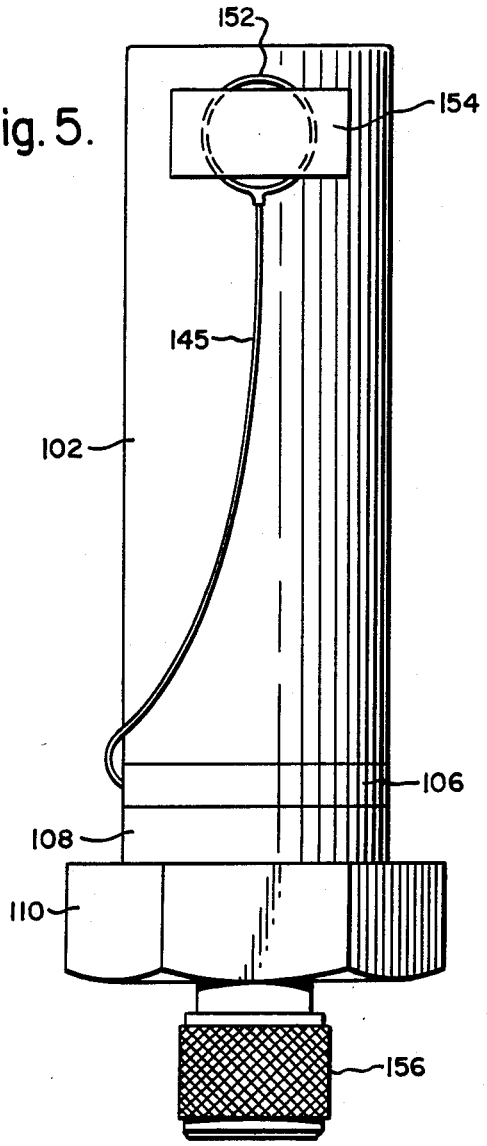
Fig. 6.
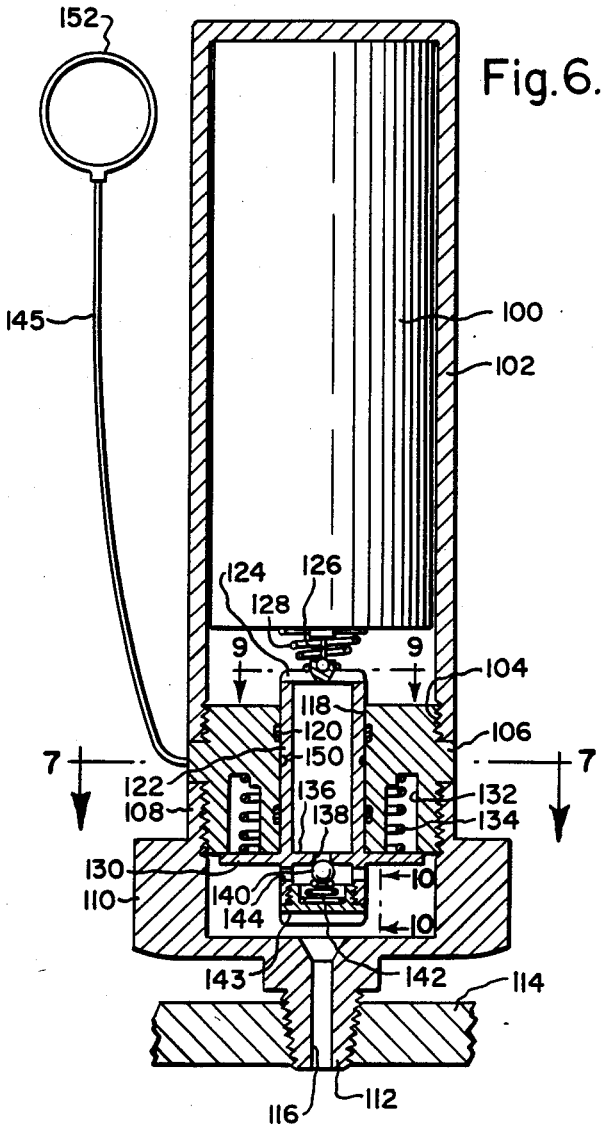
Fig. 10.
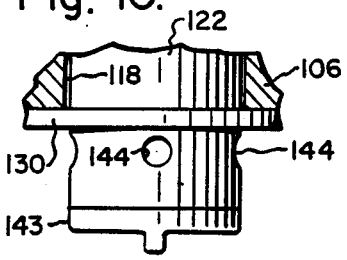
Fig. 8.
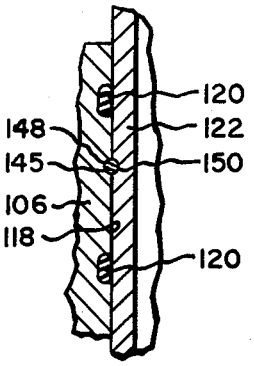
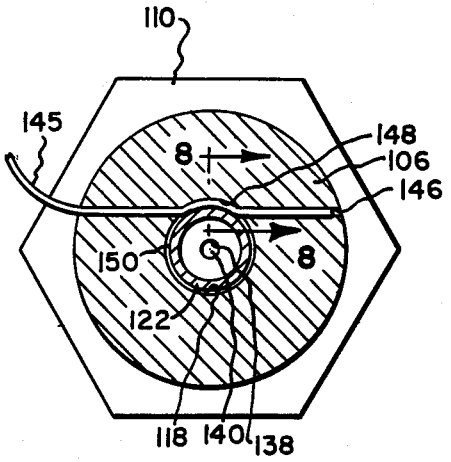
Fig. 7.
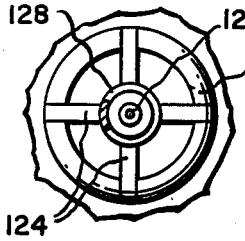
Fig. 9.

OXYGEN SUPPLY SYSTEM AND DEVICE THEREFOR

TECHNICAL FIELD

The present invention relates generally to an oxygen supply system and devices therefor. More particularly, the present invention relates to a stand alone oxygen supply system associated with a mask assembly of the type including a face mask and an inflatable head harness, the oxygen supply system including a reservoir capable of almost instantaneously supplying oxygen to the mask assembly to inflate the head harness and to provide an initial startup oxygen supply, and the supply system further being capable of providing oxygen to the mask assembly for a period of time after startup. Novel oxygen supply devices are associated with the system to maintain oxygen within the reservoir under pressure during storage and/or tests.

BACKGROUND OF THE INVENTION

A commercially available oxygen mask is customarily provided with an inflatable pneumatic head harness, this form of harness being generally illustrated in U.S. Pat. No. 3,599,636 issued Aug. 17, 1971. When this unit is installed in an aircraft, it is connected directly to the aircraft main oxygen system and, prior to use, is conventionally stored in a storage box. When the mask assembly, that is to say the inflatable head harness and the face mask, is to be used, it is removed from the storage box. Before the device can be placed over the operator's head it is necessary to inflate the harness. In addition, there is also a requirement that the oxygen system not only almost instantaneously inflate the harness but supply breathing gases within a fraction of a second after removal from the storage box. Thus, in the past, if the aircraft did not have an oxygen system, these devices could not be used. A breathing device is now required for pilots when flying at high altitude in the event of a rapid decompression. Also, it has been found that in some situations the aircraft oxygen system is not as reliable as chemical oxygen generators of the type customarily referred to as chlorate candles. Therefore, it is desirable that a unit of the type shown in the aforementioned U.S. Pat. No. 3,599,636 be provided which can be utilized with a chemical oxygen generator such as a chlorate candle. However, such a mask assembly cannot be connected directly to a chlorate candle as it takes a few seconds before the volume of the gas generated by the chlorate candle is sufficient. Thus, should a rapid decompression occur, the wearer of the mask would not be able to don the head harness and to start breathing as quickly as required, especially if the situation is such as to maintain control of the aircraft while donning the unit.

OBJECTS AND SUMMARY OF THE INVENTION

It is an object of the present invention to provide an oxygen supply system which is usable with an oxygen mask assembly of the type having an inflatable head harness and a face mask, the oxygen supply system not being dependent upon the oxygen system of an aircraft, but instead relying upon chemical oxygen generators such as chlorate candles for its principal supply of oxygen.

More specifically, it is an object of the present invention to provide a stand alone oxygen supply system for an oxygen mask assembly of the type including an inflatable head harness and a face mask, the stand alone oxygen supply system including a stowage box, a reservoir, a plurality of relatively small oxygen supply devices, and a relatively large oxygen supply device, the devices utilizing chlorate candles, the various devices and reservoir all being disposed within the stowage box, and the relatively small supply devices being capable of maintaining an initial charge within the reservoir during storage and/or tests, and the relatively large device or chemical oxygen generator being capable of providing oxygen for sustained breathing of the wearer of the mask after the initial oxygen within the reservoir has been used to inflate the inflatable head harness and to provide initial breathing gas to the wearer during startup of the relatively large chlorate candle. The stowage box is of sufficient size that the oxygen mask assembly can be stored within the box except when required for use.

The foregoing objects and other objects of the present invention, as well as the structure required to accomplish the various objects, will become more apparent after a consideration of the following detailed description taken in conjunction with the accompanying drawings in which a preferred form of this invention is illustrated.

BRIEF DESCRIPTION OF THE FIGURES

FIG. 2 is a section taken generally along the line 2—2 in FIG. 1 showing one of the relatively small oxygen supply devices in its assembled position.

FIG. 3 is a view similar to FIG. 2 but with the parts rotating 90°, and the relatively small oxygen supply device being spaced a slight distance away from the reservoir.

FIG. 4 is a sectional view taken along line 4—4 in FIG. 2.

FIG. 5 is a view of another form of a relatively small oxygen supplier, the supplier being shown prior to mounting on a reservoir and with a protective cap over its mounting end.

FIG. 6 is a sectional view of the supplier shown in FIG. 5, the supplier being shown mounted on a modified reservoir.

FIG. 7 is a sectional view taken generally along the line 7—7 in FIG. 6.

FIG. 8 is a sectional view taken generally along the line 8—8 in FIG. 7.

FIGS. 9 and 10 are sectional views taken generally along the lines 9—9 and 10—10 in FIG. 6.

DETAILED DESCRIPTION

Figure 1:
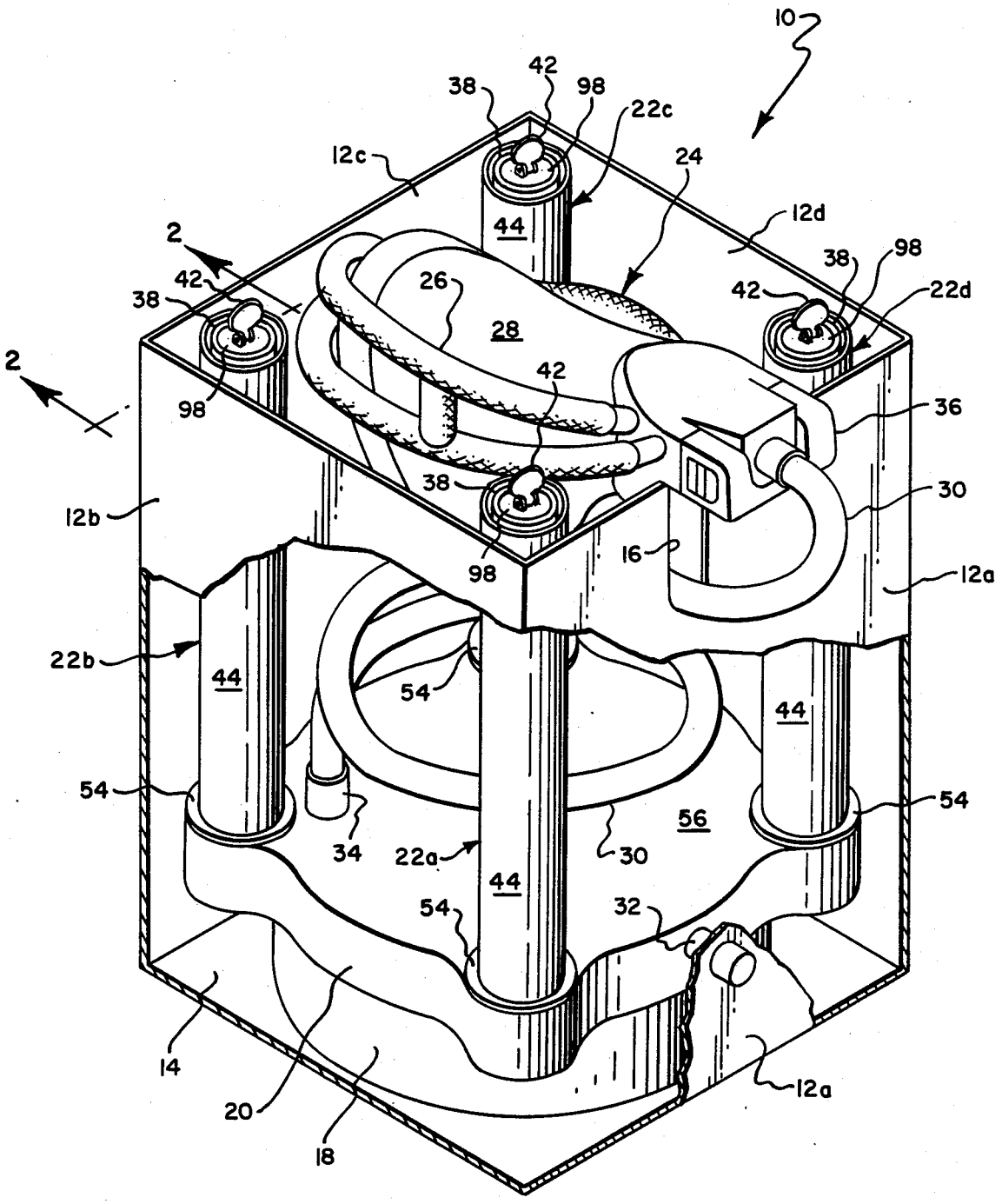
FIG. 1 is a perspective view of a stowage box containing a reservoir, a plurality of relatively small oxygen supply devices utilized to maintain an initial charge of oxygen within the reservoir, a relatively large chlorate candle, and a mask assembly including an inflatable head harness and a face mask.

Referring now in greater detail to the various figures, the oxygen supply system of this invention is incorporated within a stowage box indicated generally at 10. This stowage box as illustrated is provided with four generally rectangular sides **12*a*, 12*b*, 12*c*, and 12*d* which are interconnected to each other along adjacent sides. The stowage box is also provided with a bottom 14. One of the sides, for example 12*a*, may be provided with a cutout 16. In addition, the stowage box 10** may also be provided with a cover, but such a cover is not shown in the accompanying drawings.

The various components of the oxygen supply system are either stored or mounted within the stowage box. Thus, as can best be seen from FIG. 1, a relatively large oxygen generating means in the form of a chemical oxygen generator 18 is mounted on the bottom of the stowage box. Mounted above the chemical oxygen generator, which may be a chlorate candle in the form of a very thick pancake, is reservoir means 20. A plurality of relatively small oxygen supply means or suppliers are indicated generally at *22a, 22b, 22c,* and *22d,* each of the oxygen supply means or suppliers being mounted adjacent the intersection of two of the sides 12. Also stored within the stowage box is an oxygen mask assembly indicated generally at 24, the assembly including an inflatable head harness 26, a face mask 28, and a supply hose 30, a portion of which is coiled. The cutout 16 on side 12*a* may receive a portion of the face mask 28 and supply hose 30.

The oxygen supply system, which is mounted or stored within the stowage box is entirely self contained after installation and does not require any hookup to an oxygen supply system of an aircraft or the like. However, it is desirable that the reservoir 20 be initially filled. To this end, a fill port or inlet 32 is provided which extends from the reservoir 20 through the side 12*a* for connection to a suitable oxygen supply line so that oxygen under pressure can be initially filled within the reservoir. The fill port 32 is provided with suitable means to prevent the loss of oxygen once it has been installed in the reservoir. The initial supply of oxygen, or more specifically the oxygen under pressure within the reservoir is for the purpose of initially inflating the pneumatic head harness 26 as well as to provide an initial breathing supply during the startup of the chemical oxygen generators. Thus, when it is desired to use the oxygen mask assembly of this invention, it is removed from the stowage box and the operator will engage suitable valving means on the front of the face mask to cause the head harness to become inflated and also to provide gas under pressure to the interior of the face mask 28. In this regard it should be noted that the supply hose 30 is connected to an outlet port 34 on the top side of the reservoir 20 and also to a mask regulator 36 which is mounted on the face mask 28.

Gas under pressure cannot be stored for long intervals of time without loss of pressure. In addition, it is necessary to periodically test the system which also causes loss of pressure within the reservoir. Therefore, for the system to be operational for an extended period of time, it is necessary to provide some manner in which the pressure can be restored within the reservoir. Chemical oxygen generators in the form of chlorate candles are to be used for maintaining the pressure within the reservoir and also to provide breathing oxygen after initiation of the use of the apparatus. Once a chlorate candle has been ignited to start its operation, it cannot be stopped and restarted. Thus, if only a single large chlorate candle, such as that indicated at 18, were provided,it could not be used to both maintain the pressure within the reservoir 20 and also to provide oxygen to an aviator at some later time. Therefore, it is a feature of this invention to provide a plurality of relatively small chlorate candles, which are incorporated in the small oxygen suppliers 22, the chlorate candles being capable of maintaining the pressure within the reservoir 20.

Referring now to FIGS. 2 through 4, each of the small oxygen supply devices includes a chlorate candle 38 mounted within a cylindrical insulator 40 and candle ignition means, or operating means, which is capable of igniting the candle in response to a drop of pressure within the reservoir. Mounted at the upper end of each candle is a pivotal handle 42 for inserting the candle 38 and insulator 40 within a guide column 44, which is in turn rigidly secured within the stowage box 10. A lanyard 46 extends out of the lower end of the candle 38, the lanyard 46 being capable, when pulled away from the candle, of tripping a firing pin within the candle 38 to initiate its operation, the firing pin being of a construction well known to those skilled in the art. Extending downwardly from the cylindrical insulator 40 is an assembly means which includes a cylindrical mounting element 48 of a diameter which is only slightly less than the internal diameter of the guide column 44. Milled within the exterior surface of the cylindrical mounting element 48 are a pair of opposed J slots 50, which J slots can receive in a bayonnet type mounting fashion internal pins 52 carried by the guide column 44 adjacent its lowermost end. The lower end of guide column 44 is provided with an outwardly extending annular flange 54 which is secured to the top wall 56 of the reservoir 20 by brazing or the like. Concentric with the axis 58 of the guide column 44 is an aperture in the reservoir top wall 56, which aperture is defined by a downwardly extending cylindrical portion 60 is provided with an O-ring 62. A piston and check valve assembly, indicated generally at 64, is slidable within the cylindrical portion 60. The piston and valve assembly includes a firing spring release tube 66 which has an open top, internal threads formed adjacent its lower end, and discharge ports 67 in the side wall of the tube above the threaded end. An apertured valve plate in the form of a disk 68 having a centrally located valve port or aperture 69 is disposed above the discharge ports 67, the disk 68 being secured to the tube in a manner to insure a fluid tight seal between the tube and the disk. A threaded plug 70 is received in the lower end of the tube 66, and a spring 71 and a ball 72 are disposed between the plug 70 and the disk 68. The spring, ball, and apertured disk 68 function as a check valve, and the threaded plug varies the pressure at which the check valve will permit fluid to flow through the valve port or opening 69 and then through ports 67. Another apertured disk 73 is secured to the tube 66 above the discharge ports 67. One end of a compression spring 74, which is disposed about the cylindrical portion 60, bears against the top surface of disk 73, the other end of spring 74 bearing against the lower surface of the top wall 56. When the various parts are in their fully assembled position, the spring 74 will normally bias the piston assembly 64 downwardly against the pressure within the reservoir 20. In this connection it should be noted that the pressure to the top side of the piston assembly 64 is normally at ambient. In the event that there is no pressure within the reservoir 20, a pin 76, which passes through the firing spring release tube 66, prevents the piston assembly 64 from dropping within the reservoir. An arming sleeve 28, which is a cylindrical element having its lower end secured to the top 56 of the reservoir 20, is also concentric with the axis 58. Disposed in between the arming sleeve 78 and the guide column 44 is a compression washer 80.

Disposed within the cylindrical mounting element 48 are movable means in the form of a pair of links 82, 84, which are slotted at their adjacent end portions, the slots receiving a pivot pin 86 about which one end of the lanyard 46 is disposed. Intermediate portions of the links 82 and 84 are supported by pivot pins 88, 90, respectively. The pivot pins 88 and 90 have their ends carried by the mounting structure 91 which extends downwardly from the candle 38. The ends of the links 82, 84 remote from the pivot pin 86 are contacted, prior to the insertion of the chlorate candle 38 within the guide column 44, by an annular keeper 92, which may be in the form of a cylindrical element, the keeper 92 in turn being normally IIIbiased downwardly by a compression spring 94. A firing spring 96 contacts the links 82, 84 on the other side of the pivot pins 88, 90 and would normally bias the adjacent portions of the links downwardly to extend the lanyard 46. The pivoted links 82, 84, lanyard 46, pivot pin 86, and firing spring 96, along with the firing pin, referred to above, form the ignition or operating means of the embodiment shown in FIGS. 2–4. Similarly, the annular keeper 92 and the compression spring 94 form the keeper means of this embodiment.

While only one of the small oxygen suppliers has been described, it should be appreciated that the other suppliers are of all essentially the same construction. However, in order to cause these various elements to operate in a sequential manner, which will be more fully described below, it should be appreciated that the springs 72 are of varying force. Alternatively, the cylindrical portions 60 could be of varying diameters. For example, assuming that the suppliers 22*a*, 22*b*, 22*c*, and 22*d* are to be fired sequentially in the order listed, then the strength of the springs 72 would progressively decrease if the piston assemblies 64 were all of the same diameter. Alternatively, the diameter of the piston assemblies 64 and cylindrical portions 60 could progressively increase.

While not shown in the various drawings, it should be appreciated that the relatively large chemical oxygen generator 18 is also interconnected to the reservoir in such a manner that when ignited its output will be fed into the reservoir. Furthermore, it should be appreciated that the manner of igniting the relatively large oxygen generator could be somewhat similar to that of the relatively small oxygen generators in the sense that it could be provided with further operating means responsive to falling presure within the reservoir, which further operating means will in turn initiate operation of the larger candle.

After the relatively large chemical-oxygen generator 18, reservoir 20, guide columns 44, piston assembly 64, arming sleeve 78 and compression washer 80 have been initially assembled within the stowage box along with the oxygen mask assembly, it is necessary to provide the reservoir 20 with an initial charge of oxygen. When this is done the piston assemblies will be moved to their raised position by the pressure within the reservoir 20. At this time it is now possible to insert the various candle assemblies, and this is done by lowering the candle, the cylindrical insulator 40, and cylindrical mounting element 48 into the associated guide tube 44. After the assembly has been inserted most of the way, the lower surface of the mounting element will normally contact the upper surface of the pins 52. By rotating the assembly in a clockwise direction, when viewed from the top, the pins 52 will be caused to enter the slots 50 and downward movement will compress the washer 80 providing a seal along the lower surface, and further turning movement will effectively lock the assembly in its operative position. This described operation is done with each of the candle assemblies 22. During the final installation of each of the candles, the arming sleeve 78 will come into contact with the annular keeper 92 forcing it upwardly against the spring 94. This would normally permit the compression spring 96 to cause the links 82 and 84 to pivot about pins 88 and 90 extending the lanyard 46 and causing the candle 38 to fire. However, firing spring release tube 66, which is held in its raised position by the pressure within the reservoir 20, will contact the links and prevent the links from pivoting about pins 88 and 90 as long as pressure is maintained within the reservoir 20.

Assume that the oxygen supply system of this invention has been loaded with an initial supply of oxygen under pressure within the reservoir 20, and has been further loaded by mounting four chlorate candles 38 within the guide tubes 44. If the system is to be stored and/or tested over an extended period of time prior to use, the pressure within the reservoir will decrease. As the pressure decreases, the spring 74 will cause the piston assemblies 64 to move down within the associated cylindrical portions 60 which will permit the springs 96 to extend the lanyards 46. Typically spring 72 in supplier 22*a* will be stronger than any of the other springs (the other springs being progressively weaker) and this will eventually cause the candle 38 within column 22*a* to fire. When this happens, the pressure within the cylindrical mounting element 48 will unseat the ball 72 of the check valve, thereby permitting oxygen to flow into the chamber or reservoir 20 to build up the pressure in the reservoir back to its fully charged position. Excess oxygen may be vented through a relief valve (not shown). After the candle in column 22*a* has been operated, it may be either replaced or, if it is not replaced, when pressure again falls within the reservoir 20 due to leaking and/or testing, the next candle in 22*b* may be caused to be operated. This sequence of events will continue to happen until all of the small candles have either been exhausted or replaced. It should be appreciated that when a candle assembly is withdrawn after use, that the pressure within the reservoir will force the piston assembly up. In addition, the check valve 72 will also be closed.

Assume now that the mask assembly is to be donned. It is first withdrawn from the storage box, and the operator will cause the initial charge of oxygen within the reservoir to inflate the inflatable head harness 26 so that the mask 28 and harness can be donned. There will also be sufficient additional oxygen within the reservoir 20 to provide oxygen for the operator for a very limited period of time. As the oxygen from the reservoir 20 is used during the initial startup procedures set forth above, the pressure within the reservoir will drop. This will initiate the operation of one of the smaller candles, or, if these have all been exhausted, the operation of the large candle. The large candle is so sized that it would provide oxygen to the operator for a period of 10–15 minutes.

In order to determine whether or not a candle has been used, a thermal sensitive coating 98 is provided, this coating being disposed on the top of the candle adjacent the handle 42. This coating will have one color before the candle has been fired and another candle after the candle has been fired so that the operator can determine whether or not a candle has been fired, and if so, replace it.

While one embodiment of this invention has been illustrated in FIGS. 1 through 4, it should be noted that this embodiment requires that the pressure responsive means, namely the piston and check valve assembly 64, be incorporated in the reservoir 20. In FIGS. 5 through 10 the pressure responsive means is incorporated within the oxygen supply devices 22. This will make it possible for the oxygen supply devices to simply be screwed into threaded ports within a reservoir in the manner illustrated in FIG. 6. Alternatively, the threaded ports in the reservoir may be provided with suitable valving means which will prevent a loss of fluid under pressure within the reservoir during removal and insertion of the oxygen supply device of the type illustrated in FIGS. 5 through 10.

Referring now in greater detail to FIGS. 5 through 10, the oxygen supply devices illustrated in these figures include a chemical oxygen generator in the form of a chlorate candle 100, the chlorate candle being mounted within a cylindrical insulator 102 which may be provided with a thermal sensitive coating 98 on its upper end. The cylindrical insulator terminates at its lower end in an internally threaded portion 104 which is screwed onto one end portion of a structure 106. The other end of the structure 106 is also provided with threads which are received within the internally threaded upper end portion 108 of assembly means 110. The assembly means 110 is generally of hexagonal cross section as can best be seen from FIG. 7 and is provided with a lower externally threaded end portion 112 which may be received within a corresponding threaded aperture within the top wall 114 of a reservoir or the like. The threaded end portion 112 is provided with an aperture 116 which extends throughout the length of the assembly means 110.

The structure 106 is provided with an inner cylindrical bore 118 provided with circumferentially extending grooves which receive 0-rings 120. A hollow piston 122 is mounted within the bore 118. At the upper end the piston 122 is provided with crossed bars 124 (FIG. 9). A lanyard 126 is provided, one end of the lanyard being secured to a firing pin within the candle 100, and the other end of the lanyard 126 being secured to the crossed bars 124. A firing spring 128 is provided which has one end that bears against the candle 100 and an other end which bears against the bars 124 to normally force the bars, piston and lanyard away from the candle 100. The end of the piston spaced away from the lanyard 126 is provided with an outwardly extending flange 130 which can bear against the end of the structure 106 opposite the candle 100. An annular groove 132 is provided within the structure 106 and receives a compression spring 134 bears against the flange 130. Spaced inwardly of the flange 130 is a check valve assembly which includes a valve seat 136 provided with an aperture 138. A check ball 140 is normally spring biased into engagement with the valve seat 136 about the aperture 138 by means of spring 142. The other end of the spring 142 bears against a plug 143 which is screwed into an end of the piston 122. The piston is provided with radially outwardly extending apertures 144 between the plug 143 and the flange 130. The lanyard 126, spring 128, and movable piston 122 cooperate with each other to form ignition means which are capable after assembly of the generator onto the reservoir of igniting the generator in response to a drop of pressure within the reservoir. Thus, if the pressure sensed through aperture 116 should fall below a predetermined minimal amount, the spring 134 will bear against the flange 130 to move the piston and lanyard away from the candle 100, which will in turn cause the firing pin within the candle 100 to ignite the candle. In order to prevent premature ignition from occurring before the oxygen supply device has been mounted onto a reservoir, it is necessary to provide keeper means which are interconnected with the ignition means and which are capable of preventing the operation of the ignition means prior to the assembly of the generator onto the reservoir. In the embodiment illustrated, the keeper means includes a wire 145 which extends through a suitable aperture 146 (FIG. 7) in the structure 106, the aperture 146 being provided with a groove portion 148 (FIG. 8) which mates with a corresponding groove portion 150 in the surface of the piston 122. Thus, that portion of the wire 145 which lies between the two grooved portions 148 and 150 will prevent relative axial movement of the piston 122 with respect to the cylinder within the structure 106. However, it should be obvious that if the wire were withdrawn relative axial movement of the piston within the cylinder would be possible. To this end, the wire is provided with a ring 152 which is secured at an end of the wire remote from the structure 106, the ring normally being taped to the surface of the cylindrical insulator 102 by a piece of tape 154. In order to prevent damage to the threaded end portion 112 before the device is assembled onto a reservoir, a protective cap 156 is normally secured thereto.

The operation of the embodiment illustrated in FIGS. 5 through 10 should be obvious as it functions in a manner similar to that of the embodiment shown in FIGS. 1 through 4. To assemble such a device onto a reservoir the protective device or cap 156 is removed and the threaded end portion 112 is screwed into a suitable aperture within the top 114 of a reservoir. After all of the small oxygen supply devices have been assembled onto the top of the reservoir, the reservoir is provided with an initial charge of oxygen. At this time the small oxygen suppliers can be armed merely by pulling on the rings 152. The pressure within the reservoir, after it has received its initial charge, will initially force the piston to its raised position where the flange 130 bears against a lower surface of the structure 106. As the pressure within the reservoir drops during storage and/or tests, the pistons will move downwardly causing the oxygen supply devices to be sequentially fired. This can be controlled by using differing springs 134. After all four of the units have been fired, it is necessary to replace all of these units and again the procedure set forth above will be followed. Thus, after all new replacement units have been mounted on the reservoir, a further oxygen charge is provided to the reservoir before the new units are armed.

It should also be noted that the oxygen supply devices of the type shown in FIGS. 5 through 10 may find application in other devices than with the oxygen supply system of the type illustrated in FIG. 1.

While preferred structures in which the principles of the present invention have been incorporated are shown and described above, it is to be understood that this invention is not to be limited to the details shown and described above but that, in fact, widely differing means may be employed in the broader aspects of this invention.

What is claimed is:

1. A stand alone oxygen supply system capable of maintaining an initial supply of oxygen under pressure, said system also being capable of providing further oxygen when required in addition to that available from the initial supply; said system comprising:

an oxygen mask assembly including means for supplying a regulated flow of oxygen to a user;

reservoir means capable of containing an initial supply of oxygen under an initial level pressure, said reservoir means being interconnected to the oxygen mask assembly and capable of providing the initial supply of oxygen to the mask assembly during startup;

a plurality of relatively small supply means, said supply means including first operating means responsive to the pressure in said reservoir means for connecting said supply means to said reservoir means when a first predetermined decrease in pressure is sensed therein and thereby replenishing said reservoir means with oxygen to an increased pressure level, wherein the supply of oxygen within the reservoir means can be maintained under pressure during storage and/or tests; and a relatively large chemical oxygen generating means, said generating means including second operating means responsive to pressure in said reservoir means for connecting said generating means to said reservoir means when a second predetermined decrease in pressure is sensed therein, said second predetermined decrease in pressure being greater than said first predetermined decrease in pressure, whereby oxygen is provided to the mask assembly when required for a period of time after startup.

2. The oxygen supply system as set forth in claim 1 wherein the mask assembly includes an inflatable head harness and a face mask.

3. The oxygen supply system as set forth in claim 1 wherein the plurality of relatively small oxygen supply means are chemical oxygen generators.

4. The oxygen supply system as set forth in claim 1 wherein said first operating means causes the relatively small oxygen supply means to be operated sequentially.

5. The oxygen supply system as set forth in claim 4 wherein said second operating means causes the relatively large chemical oxygen generating means to be operated after all of the relatively small oxygen supply means have been caused to be operated.

6. The oxygen supply system as set forth in claim 1 wherein the relatively large chemical oxygen generating means is a chlorate candle having its output interconnected with said reservoir means.

7. The oxygen supply system as set forth in claim 1 further characterized by the provision of a stowage box, the relatively small oxygen supply means, the relatively large chemical oxygen generating means, and the reservoir means being mounted within the stowage box for operation, and the oxygen mask assembly normally being stored within the stowage box prior to use.

8. The oxygen supply system as set forth in claim 7 wherein the stowage box has generally rectangular sides, the reservoir means and the relatively large chemical oxygen generating means being mounted in the base of the stowage box, the small oxygen supply means being mounted above the reservoir means adjacent the intersection of various sides, and the oxygen mask assembly being normally mounted within the stowage box above the reservoir means and relatively large chemical oxygen generating means and between the various small oxygen supply means.

9. The oxygen supply system as set forth in claim 8 wherein the relatively small oxygen supply means are chlorate candles.

10. The oxygen supply system as set forth in claim 9 wherein said first operating means comprises mechanical operating means which sense the pressure within the reservoir means, said mechanical operating means being connected to the relatively small oxygen supply means, and wherein the relatively small oxygen supply means are sequentially operated by the mechanical operating means.

11. The oxygen supply system as set forth in claim 1 further characterized by the provision of a fill port interconnected with said reservoir means and capable of permitting an initial charge of oxygen to be filled within the reservoir means.

12. In combination with an oxygen supply system having a stowage box and an oxygen mask assembly normally stored within the stowage box prior to use, the oxygen mask assembly including an inflatable head harness and means for supplying a regulated flow of oxygen to a user;

the improvement comprising:

reservoir means disposed within the stowage box, said reservoir means being capable of containing an initial supply of oxygen under an initial pressure level and further being interconnected to the oxygen mask assembly, the reservoir means being capable of supplying oxygen to the mask assembly during startup;

a plurality of relatively small oxygen supply means mounted within the stowage box, said supply means including first operating means responsive to the pressure in said reservoir means for connecting said supply means to said reservoir means when a first predetermined decrease in pressure is sensed therein and thereby replenishing said reservoir means with oxygen to an increased pressure level, wherein the supply of oxygen within the reservoir means can be maintained under pressure during storage and/or tests; and relatively large chemical oxygen generating means mounted within the stowage box, said generating means including second operating means responsive to pressure in said reservoir means for connecting said generating means to said reservoir means when a second predetermined decrease in pressure is sensed therein, said second predetermined decrease in pressure being greater than said first predetermined decrease in pressure, whereby oxygen is provided to the mask assembly when required for a period of time after startup.

* * * * *

UNITED STATES PATENT AND TRADEMARK OFFICE

CERTIFICATE OF CORRECTION

PATENT NO. : 4,664,108

DATED : May 12, 1987

INVENTOR(S) : William K. Ansite

It is certified that error appears in the above-identified patent and that said Letters Patent are hereby corrected as shown below:

Claim 1, line 9, delete "level" before pressure and insert --level-- after pressure.

Signed and Sealed this

Twenty-seventh Day of October, 1987

*Attest:*

DONALD J. QUIGG

*Attesting Officer*

*Commissioner of Patents and Trademarks*